US011529597B2

(12) United States Patent
Shen et al.

(10) Patent No.: US 11,529,597 B2
(45) Date of Patent: Dec. 20, 2022

(54) TURNTABLE COLOR MACHINE

(71) Applicant: ZHENGZHOU SANHUA TECHNOLOGY & INDUSTRY CO., LTD., Henan (CN)

(72) Inventors: Ruhua Shen, Henan (CN); Huan Li, Henan (CN)

(73) Assignee: ZHENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 261 days.

(21) Appl. No.: 16/777,564

(22) Filed: Jan. 30, 2020

(65) Prior Publication Data

US 2020/0246767 A1 Aug. 6, 2020

(30) Foreign Application Priority Data

Jan. 31, 2019 (CN) ..... 201910097067.4
Jan. 31, 2019 (CN) ..... 201920171702.4

(51) Int. Cl.
*B01F 33/35* (2022.01)
*B01F 35/12* (2022.01)
(Continued)

(52) U.S. Cl.
CPC ..... *B01F 33/35* (2022.01); *B01F 35/121* (2022.01); *B01F 2035/351* (2022.01); *B01F 2101/30* (2022.01)

(58) Field of Classification Search
CPC ..... B01F 9/0021; B01F 13/0098; B01F 13/1055; B01F 15/0247; B01F 15/00045;
(Continued)

(56) References Cited

U.S. PATENT DOCUMENTS 3,074,597 A * 1/1963 Felts ..... G01J 3/46 141/90
5,474,211 A * 12/1995 Hellenberg ..... B01F 35/7174 222/144.5
(Continued)

FOREIGN PATENT DOCUMENTS

CN 105757023 B * 12/2017
WO WO-2020057458 A1 * 3/2020 ..... B01F 15/02

OTHER PUBLICATIONS

Niu Weihong, Translated Patent Application of CN105757023B (Year: 2017).*
Yu Jianhua, Translated Patent Application of WO2020057458A1 (Year: 2020).*

*Primary Examiner* — David L Sorkin
*Assistant Examiner* — Noor F Ahmad
(74) *Attorney, Agent, or Firm* — Hamre, Schumann, Mueller & Larson, P.C.

(57) ABSTRACT

The present invention provides a turntable color machine includes a rack, a controller is arranged on the rack, a wheel-type turntable that rotates vertically is arranged on the rack, a plurality of color paste bags are arranged on the wheel-type turntable, the color paste bags are evenly arranged along the circumference of the wheel-type turntable, the color paste bags are connected with a piston pump that is driven by a lifting mechanism to perform constant volume injection via a valve body, and a material receiving device that moves up and down is arranged at the middle of the wheel-type turntable. The piston pump is connected with the color paste bags to achieve volume injection, the wheel-type turntable drives the color paste bags to perform a circular motion, so that the color paste in the color paste bags are turned up and down to achieve an even mixing effect, no stirring device needs to be added, so that the manufacturing cost is reduced, the plunger valves are arranged in the color paste bags, the air in the color paste bags is extracted through
(Continued)

the air suction cylinder to ensure that there is no air in the color paste bags, to prevent the color paste from deteriorating and to prolong the service life of the color paste.

10 Claims, 12 Drawing Sheets

(51) Int. Cl.
*B01F 35/30* (2022.01)
*B01F 101/30* (2022.01)

(58) Field of Classification Search
CPC ..... B01F 2215/005; B01F 2215/00084; B01F 2035/351; B01F 2101/30; B01F 29/322; B01F 33/35; B01F 33/84; B01F 35/121; B01F 35/717613
USPC ..... 366/182.4
See application file for complete search history.

(56) References Cited

U.S. PATENT DOCUMENTS

2003/0062379 A1* 4/2003 Bartholomew ..... B65B 25/00 435/100
2005/0087545 A1* 4/2005 Petrus Engels ..... B01F 13/1058 222/1
2005/0194403 A1* 9/2005 Mink ..... B01F 33/846 222/135
2005/0247730 A1* 11/2005 Post ..... B01F 15/00123 222/144
2006/0169718 A1* 8/2006 Buining ..... B01F 15/0454 222/144
2012/0248147 A1* 10/2012 Krom ..... B01F 13/1058 222/135
2014/0000760 A1* 1/2014 Sacchet ..... B01F 15/0445 141/83
2014/0346191 A1* 11/2014 Brule ..... B67D 7/78 222/144
2021/0393829 A1* 12/2021 Hörsting ..... A61L 2/202

* cited by examiner

TURNTABLE COLOR MACHINE

FIELD OF THE INVENTION

The present invention relates to the technical field of color mixing or paint, and particularly relates to a turntable color mixing machine.

BACKGROUND OF THE INVENTION

When color matching is carried out before the spraying of a vehicle refinishing paint, one of the commonly used methods is to compare color cards with the color of a vehicle to find a color card of the same color, a color masterbatch ratio of a color card number and color masterbatch weight formulas are searched in a color matching software database in a computer according to the color card number, the necessary types of color masterbatches are manually weighed according to the formula, and are mixed and stirred to prepare the vehicle refinishing paint (referred to as vehicle paint below) consistent with the color of the color card. The labor efficiency is low, the vehicle refinishing paint formulated according to the color card usually has a certain deviation from the color of the vehicle, and thus needs to be further adjusted manually, which is laborious and requires higher technical skills of color mixing workers, and only the experienced color mixing workers can formulate the vehicle paint with the consistent color.

In the prior art, there is also a method for finding a paint spraying formula at the factory according to a model number or a paint code of the vehicle or measuring the surface paint of the vehicle by using an optical instrument (spectrophotometer) to obtain a paint formulating formula, the obtained formulating method can be suitable for the analysis of most vehicle surface paints, is more accurate and reduces the color error between the vehicle paint formulated according to the vehicle model or the paint code and the actual vehicle paint. But even so, the previously counted data show that a considerable proportion of vehicle surface paints still have color differences after once color mixing, and further manual color matching correction is still needed. Therefore, the color matching of the existing vehicle refinishing paint has high requirements on labor and is highly dependent, the efficiency of artificial color matching is low, especially in some paint mixing shops, the amount of color matching in a day is very large, which can reach dozens or hundreds, the color matching can not be completed by one color matching worker, and some stores even require two or four color matching workers. Even so, people are still reluctant to do the job of color matching because of the high labor intensity, the poor environment (colors stick everywhere, and even the body) and the long term for improving the skill. On the other hand, it is also very difficult to recruit an excellent color matching worker, and nobody is willing to do the job for a low salary. However, the color matching technicians are necessary at present, for paint mixing shops with very small color mixing amount or for shops in which the color mixing is only auxiliary business (some 4S shops as an example), the earnings are sufficient to pay the salary of a color mixing worker. Therefore, if there is a device on the market that automatically and accurately allocates the amount of each color masterbatch for color matching, the purposes of improving the efficiency, reducing the technical requirements for color mixing and reducing the labor cost can be achieved.

In fact, in recent years, some companies have developed automatic color mixing machines of vehicle refinishing paint. But no stable product is formed to launch on the market.

As we all know, the existing mature and universal vehicle paint color mixing methods in the world all adopt a weight ratio manner, and the color masterbatches are manually poured out from paint buckets for weighing, color matching and color mixing. That is, according to the weight requirements of the color masterbatches required for color matching, the color masterbatches are manually poured out from color masterbatch buckets provided with pulp covers at the upper parts through pulp outlets on the pulp covers. The weights of the color masterbatches required for color matching are weighed on an electronic scale. The color masterbatches required for color matching in each formula are poured out from the color masterbatch buckets and are weighed to the necessary weights in this way. The color masterbatches required for color matching are stirred and mixed to complete the color matching of the required color paint. The pulp cover has a stirring function and a function of manually controlling to pour out the color masterbatches. At present, the color mixing formulas of the manufacturers (such as: Xinjin, DuPont, PPG and BASF) who manufacture the color masterbatches of vehicle refinishing paints in the world are designed according to weight ratios at present.

There are two advantages of manual paint pouring for color mixing by using the weight ratio:

1 It is convenient to pour out the required amount of color masterbatch from the color masterbatch bucket, and it is also convenient to control the pouring amount: as long as the required weight on the weighing scale is approaching, the pouring speed of the color masterbatch is gradually slowed down by manual control, so that the pouring amount slowly approaches to the required pouring weight, and the pouring of the color masterbatch is stopped at the arrival of the required weight of the color masterbatch. The required weights of other color masterbatches for color mixing are also poured out and weighed according to the same method; and 2 Several color masterbatches required for color matching can be poured into a container to be directly stirred evenly: for example, if three color masterbatches are needed to obtain a color, the weight of each masterbatch is respectively as follows: 1.1 grams of masterbatch A, 2.2 grams of masterbatch B and 3.3 grams of masterbatch C, an empty bucket can be placed on the electronic scale, and zero clearing is performed on the weight. The masterbatch A is poured into the empty bucket until the electronic scale shows 1.1 grams. Zero clearing is performed on the electronic scale, and the masterbatch B is poured until the electronic scale shows a weight of 2.2 grams; and zero clearing is performed on the electronic scale again, and the masterbatch C is poured until the electronic scale shows 3.3 grams. Finally, the three color masterbatches are stirred evenly by using a stirring ruler to complete the color mixing and color matching.

The use of weight color matching is the first natural choice in the color mixing history. In order to avoid that the proportion of color masterbatches for color matching based on empirical color mixing cannot be accurately known and that the required amounts of color masterbatches cannot be accurately controlled, the most convenient weight ratio method based on empirical color mixing has been generated to achieve accurate color matching.

Theoretically, volume proportion color matching is also tenable. But the theoretically tenable volume proportion color matching method is difficult to implement in practice. There are several ways to obtain the color masterbatches for color matching of the required volumes by the volume proportioning method: assumption 1: the color masterbatch is manually poured into a measuring cup, and the amount of the poured color masterbatch is controlled by human eye observation according to the position of the volume scales of the measuring cup. However, there is a problem, due to the characteristics of the color paint, the accuracy of the volume of the color masterbatch determined by observing the position of the measuring scale of the measuring cup in human eyes cannot reach the required accuracy of 0.1 grams by weight, especially when a large amount of color paint needs to be blended, the volume of the measuring cup is large, the cross-sectional area of the measuring cup is larger, and the error of determining whether the color masterbatch reaches the specified scale position in human eyes is greater, and the color mixing accuracy requirements of 0.1 grams cannot met at all. Moreover, even the inaccurate volume manual color mixing method is much more difficult and tedious than the weight ratio color mixing in actual operation, so that effective color mixing and color matching cannot be realized; assumption 2: a specific gravity cup method is adopted: due to the discontinuity of wall hanging and volume measurement of the color masterbatch, it is difficult to achieve the required volume in practical application; assumption 3: manual injection pipe volume measurement injection method: since the color masterbatch residual at an injection pipe head for extracting the color masterbatch causes an accuracy error, it is troublesome and environmentally friendly to remove the residual color masterbatch, and if the color masterbatch is not removed, the color masterbatch flows to the outlet of the injection pipe head to affect the error guarantee of less than 0.1 g. Similarly, it is very laborsome to manually eject the viscous color masterbatch, and even people with small forces cannot push the injection pipe, although the injection force can be reduced by decreasing the pipe diameter of the injection pipe to improve the injection accuracy, however, it is necessary to extract the color masterbatch from a color masterbatch container for multiple times to accurately eject a large amount of color masterbatch, the residual color masterbatch needs to be removed from the pipe orifice of the injection pipe every time, furthermore, the error is accumulated with the increase in the number of times, at this time, the error of 0.1 g is more difficult to control, and this is much more complicated than the currently used weight ratio method color matching, of course, the simple and easy to achieve weight ratio method is selected in the color mixing industry for color mixing, and the volume ratio method that is troublesome and difficult to ensure the accuracy is not selected for color mixing.

SUMMARY OF THE INVENTION

The technical problem to be solved by the present invention is how to achieve accurate deployment, perform volume metering and prevent the air from entering to deteriorate the paint. In order to solve the above problem, the present invention provides a turntable color mixing machine.

The objective of the present invention is achieved in the following manner: A turntable color mixing machine includes a rack, a controller is arranged on the rack, a wheel-type turntable that rotates vertically is arranged on the rack, a plurality of color paste bags are arranged on the wheel-type turntable, the color paste bags are evenly arranged along the circumference of the wheel-type turntable, the color paste bags are connected with a piston pump that is driven by a lifting mechanism to perform constant volume injection via a valve body, and a material receiving device that moves up and down is arranged at the middle of the wheel-type turntable.

A linear driving mechanism is arranged on the rack, and the material receiving device includes a moving platform, and the moving platform is connected with the linear driving mechanism to perform up and down linear movement at the middle of the wheel-type turntable.

The linear driving mechanism includes a moving frame, a gear is connected above the moving frame through a bearing seat, the gear is connected with a moving motor through a chain, the chain is fixedly connected with a moving plate, the moving plate is connected with the moving frame through a pulley, the moving plate is fixedly connected with a material receiving platform, and a paint mixing cup is arranged on the material receiving platform.

A turntable motor is arranged above the moving frame, and a plurality of wheel pin holes are formed in the circumference of one side of the wheel-type turntable away from the piston pump, the turntable motor is connected with a columnar driving wheel, and the turntable motor drives the wheel-type turntable to rotate through driving wheel pins on the driving wheel.

A valve body deflector rod is arranged on the valve body, a paste outlet nozzle is arranged below the valve body, an injection passage is arranged in the valve body, the lifting mechanism includes a lifting frame, and a valve motor for shifting the valve body deflector rod to connect or close the injection passage and the paste outlet nozzle is arranged on the lifting frame.

A lifting driving mechanism is arranged on the lifting frame, a clamping block that moves up and down is arranged on the lifting driving mechanism, and the clamping block lifts or presses the piston rod of the piston pump.

A paste inlet is formed above the color paste bag, a paste outlet is formed below the color paste bag, the paste outlet is connected with the valve body through a paste pipe, the paste inlet is in threaded connection with a plunger valve, a sealing cover is connected above the plunger valve through threads, and the sealing cover is connected with an air suction cylinder through a hose.

The valve body is a return valve, and the piston pump is a large and small combined pump.

A plurality of supporting rods are arranged on the inner periphery of the wheel-type turntable, the color paste bag is fixedly connected with a hanging plate, and the hanging plate is fixedly connected between the supporting rod and the adjacent supporting rod.

A cleaning component for cleaning the paste outlet nozzle is arranged on the wheel-type turntable, the cleaning component includes a hair brush component and a cleaning wheel component, the cleaning wheel component includes a cleaning wheel shaft and a cotton gum cleaning wheel arranged on the cleaning wheel shaft, and the hair brush component includes a hair brush shaft and a hair brush.

Compared with the prior art, the present invention has the beneficial effects that: the piston pump is connected with the color paste bags to achieve volume injection, the wheel-type turntable drives the color paste bags to perform a circular motion, so that the color paste in the color paste bags are turned up and down to achieve an even mixing effect, no stirring device needs to be added, so that the manufacturing cost is reduced, the plunger valves are arranged in the color paste bags, the air in the color paste bags is extracted through the air suction cylinder to ensure that there is no air in the color paste bags, to prevent the color paste from deteriorating and to prolong the service life of the color paste.

1. rack, 2. color paste bag, 3. wheel-type turntable, 4. material receiving platform, 5. moving frame, 6. bearing block, 7. chain, 8. gear, 9. moving plate, 10. moving motor, 11. lifting frame, 12. stepping motor, 13. lead screw, 14. nut, 15. clamping block, 16. valve motor, 17. piston pump, 18. valve body, 19. turntable motor, 20. driving wheel, 21. driving wheel pin, 22. wheel pin hole, 23. cleaning component, 31. supporting rod, 201. hanging plate, 202. paste pipe, 203. plunger valve, 204. sealing cover, 205. air suction cylinder, 231. hair brush component, 232. cleaning wheel component, 171. piston rod, 181. valve body deflector rod, 182. paste outlet nozzle, 183. injection passage, 161. deflector rod.

DETAILED DESCRIPTION OF THE EMBODIMENTS

Figure 1:
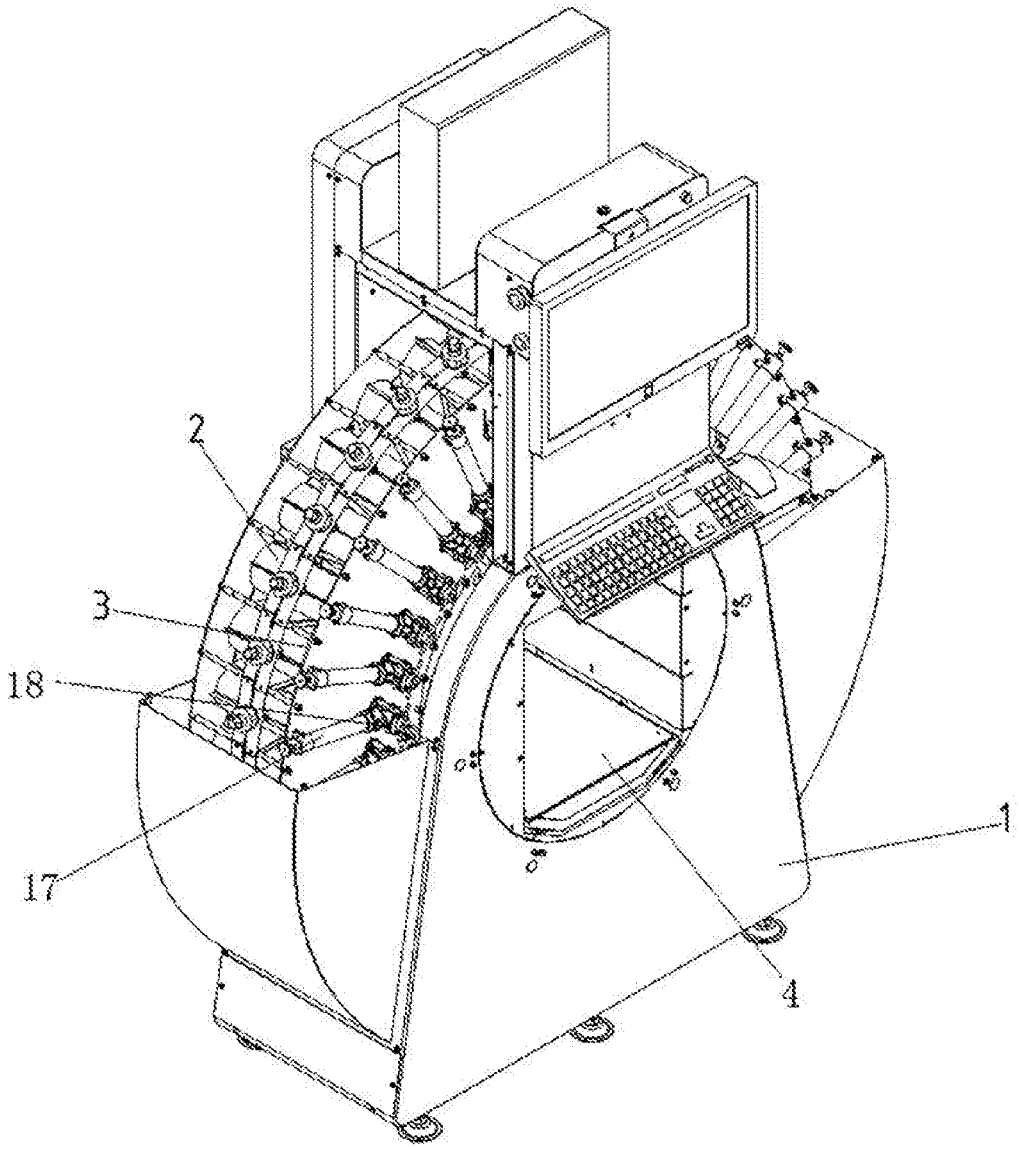
FIG. 1 is a structural schematic diagram of the present invention.
Figure 2:
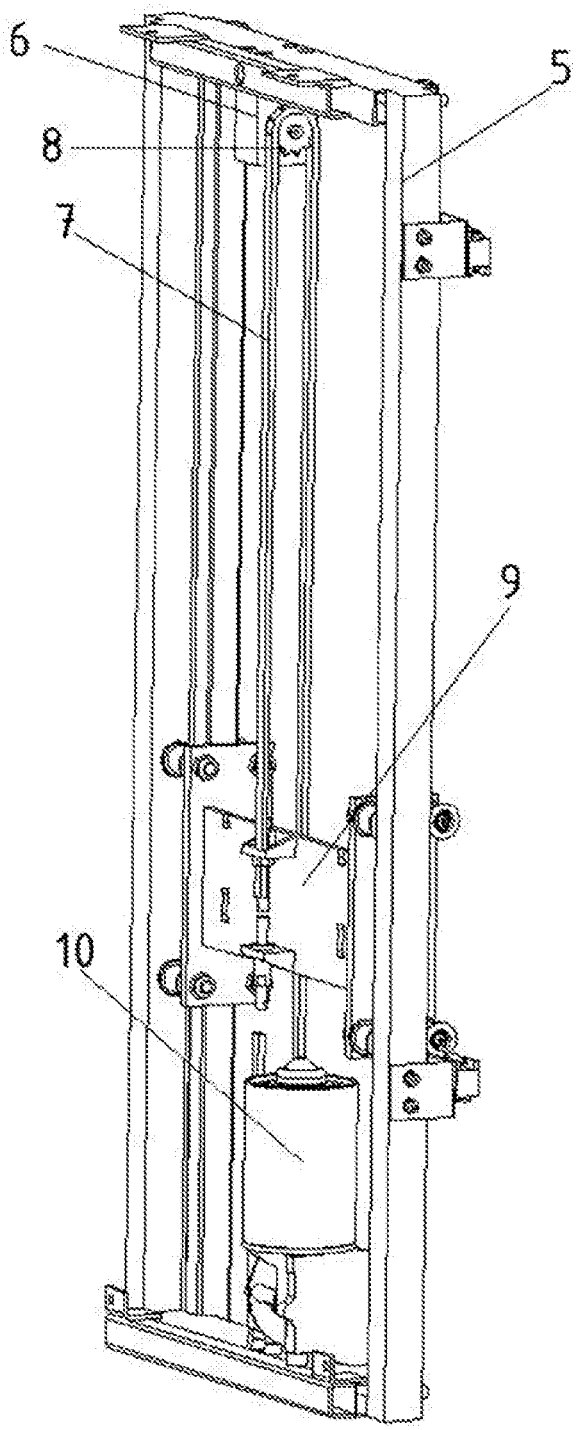
FIG. 2 is a structural schematic diagram of a linear driving mechanism.
Figure 3:
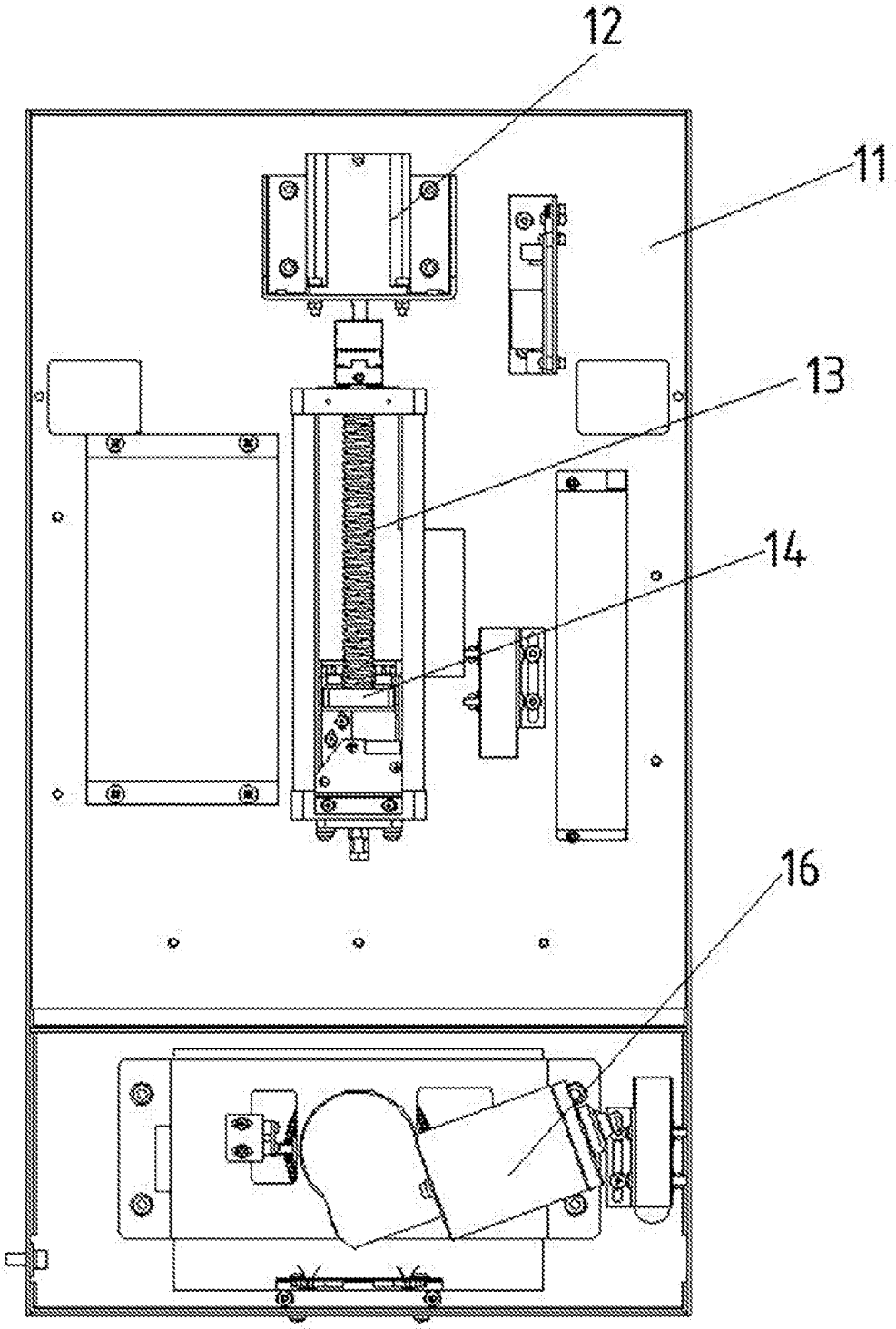
FIG. 3 is a structural schematic diagram of a lifting mechanism.
Figure 4:
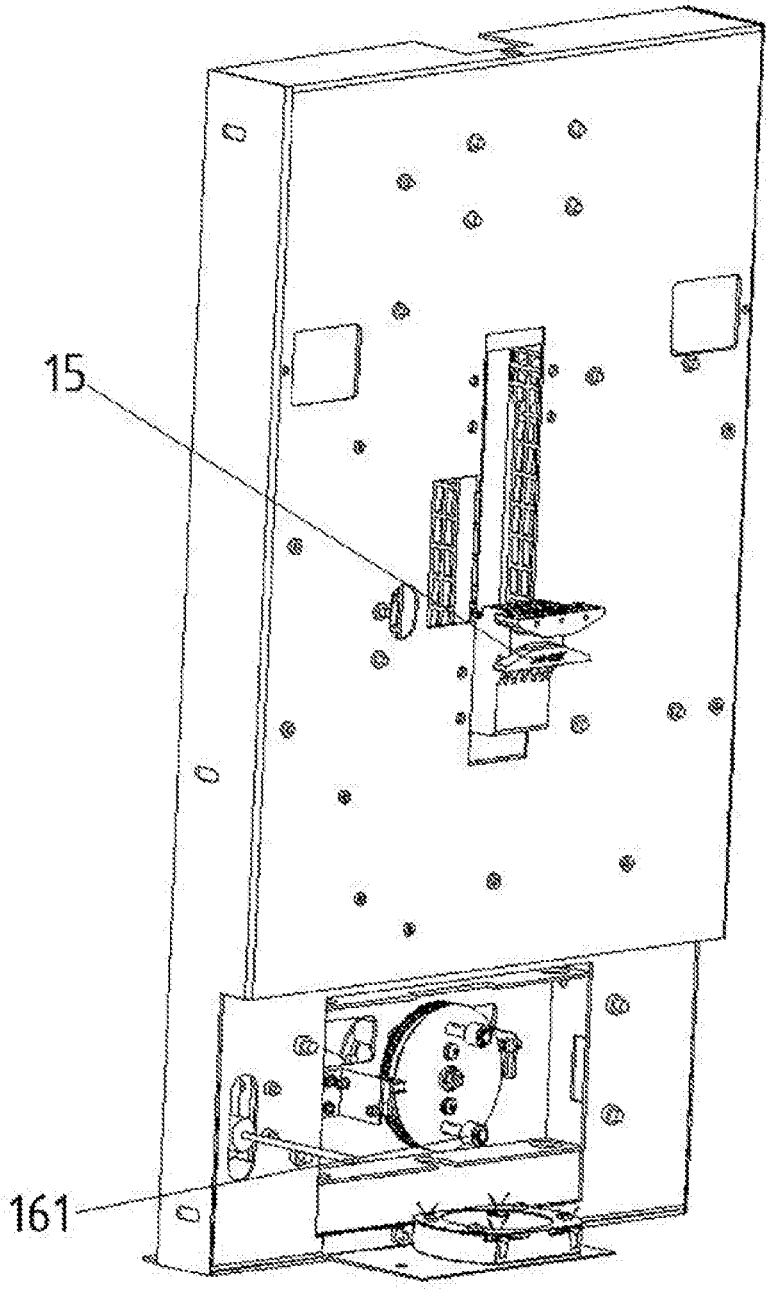
FIG. 4 is a reserve side diagram of FIG. 3.
Figure 5:
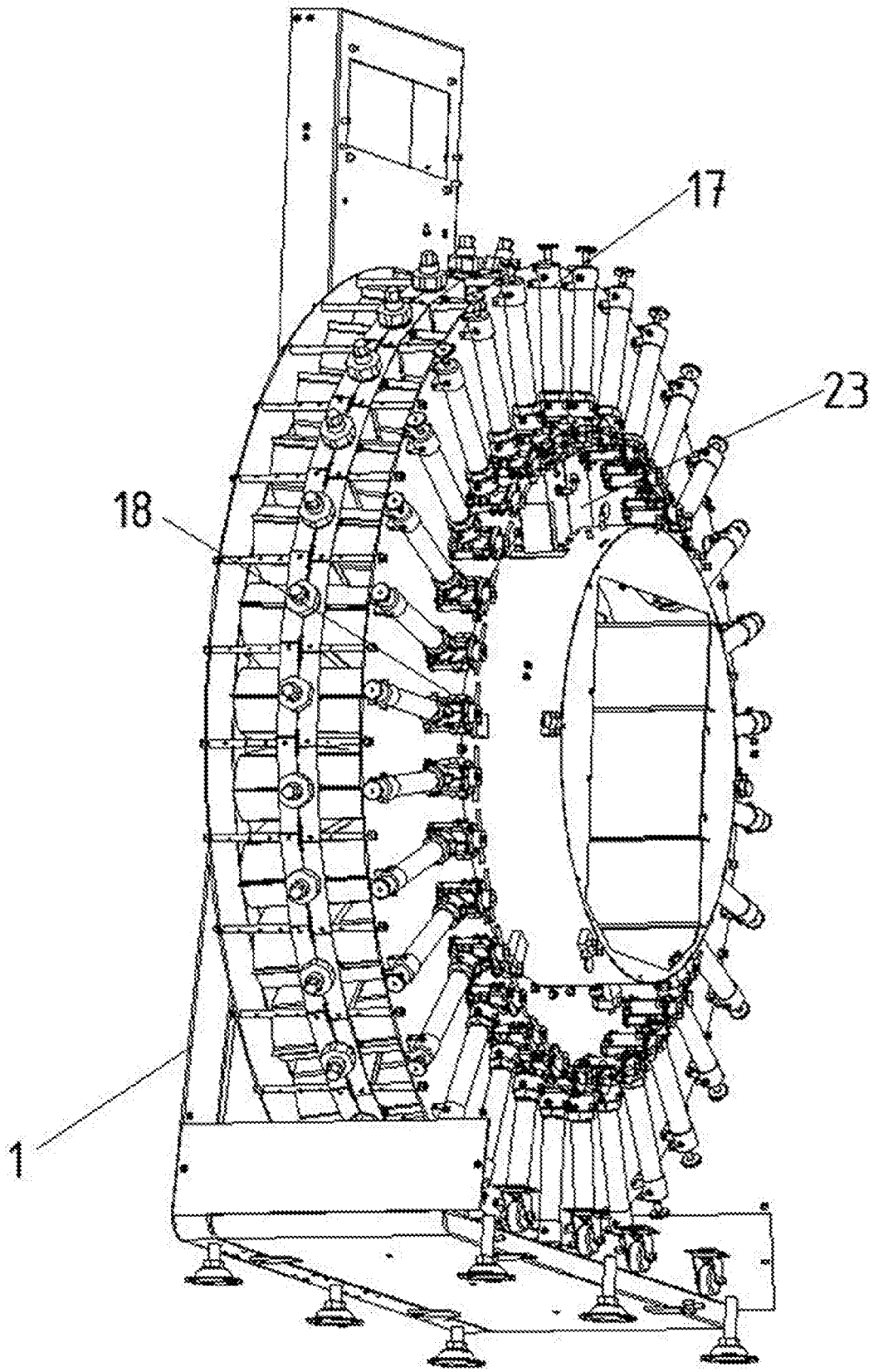
FIG. 5 is a mounting schematic diagram of a piston pump and a color paste bag.
Figure 6:
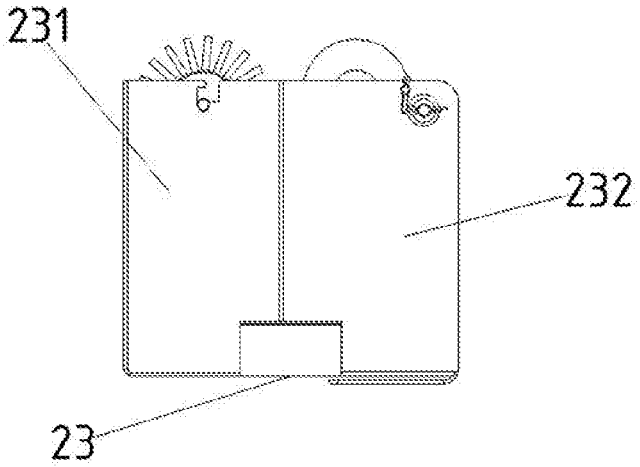
FIG. 6 is a structural schematic diagram of a cleaning component.
Figure 7:
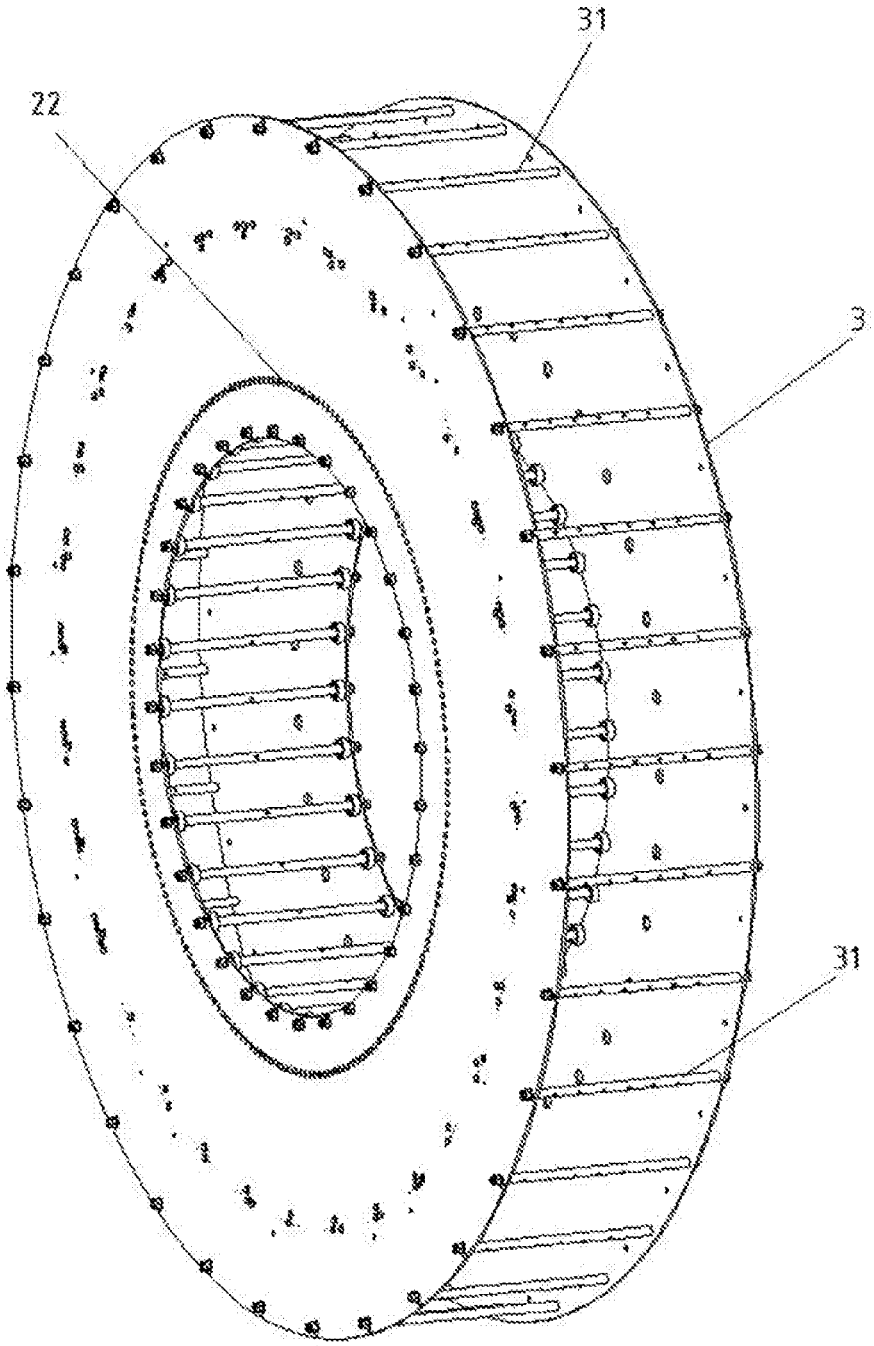
FIG. 7 is a mounting schematic diagram of a wheel-type turntable and a supporting rod.
Figure 8:
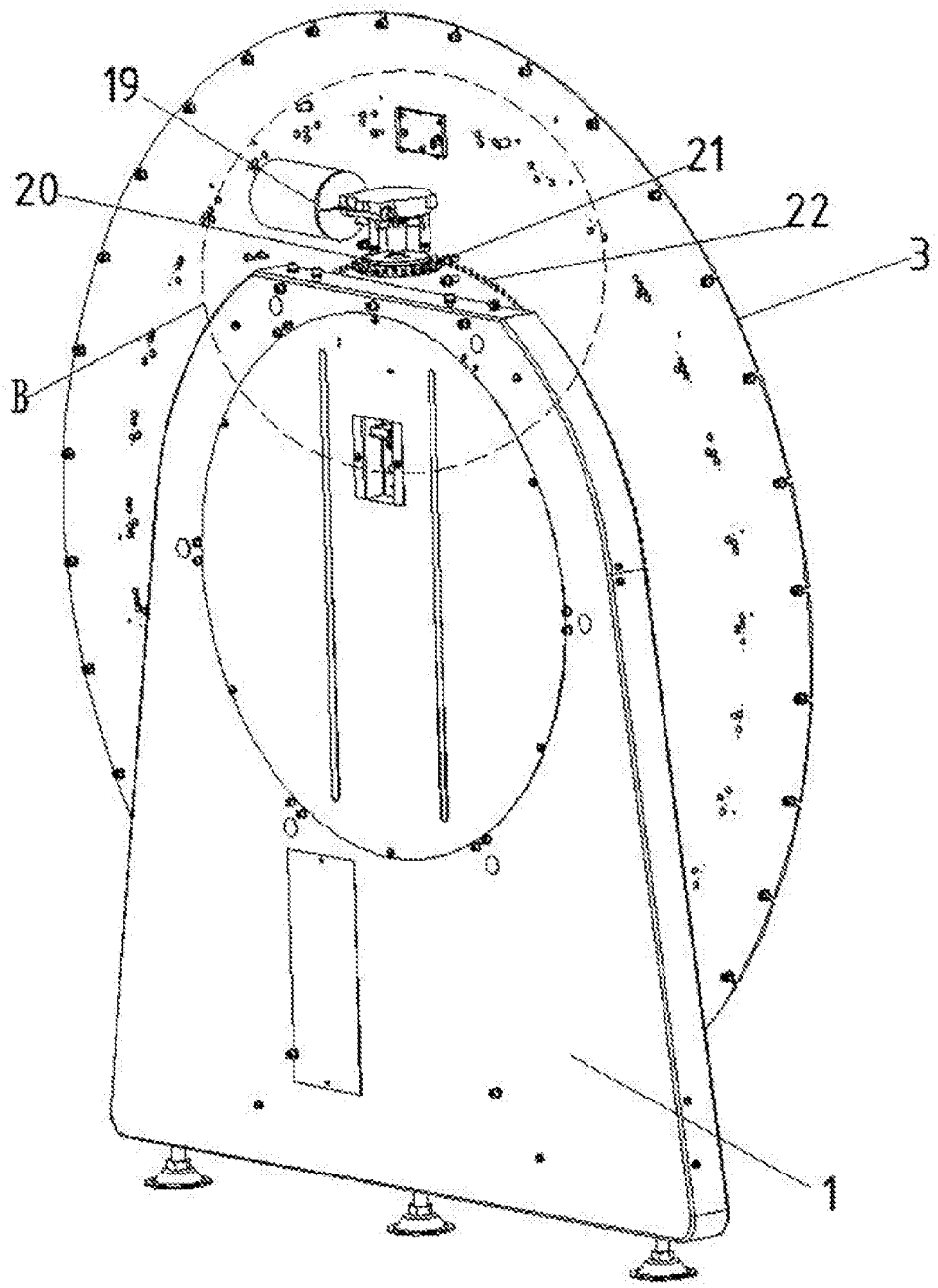
FIG. 8 is a mounting schematic diagram of a turntable motor.
Figure 9:
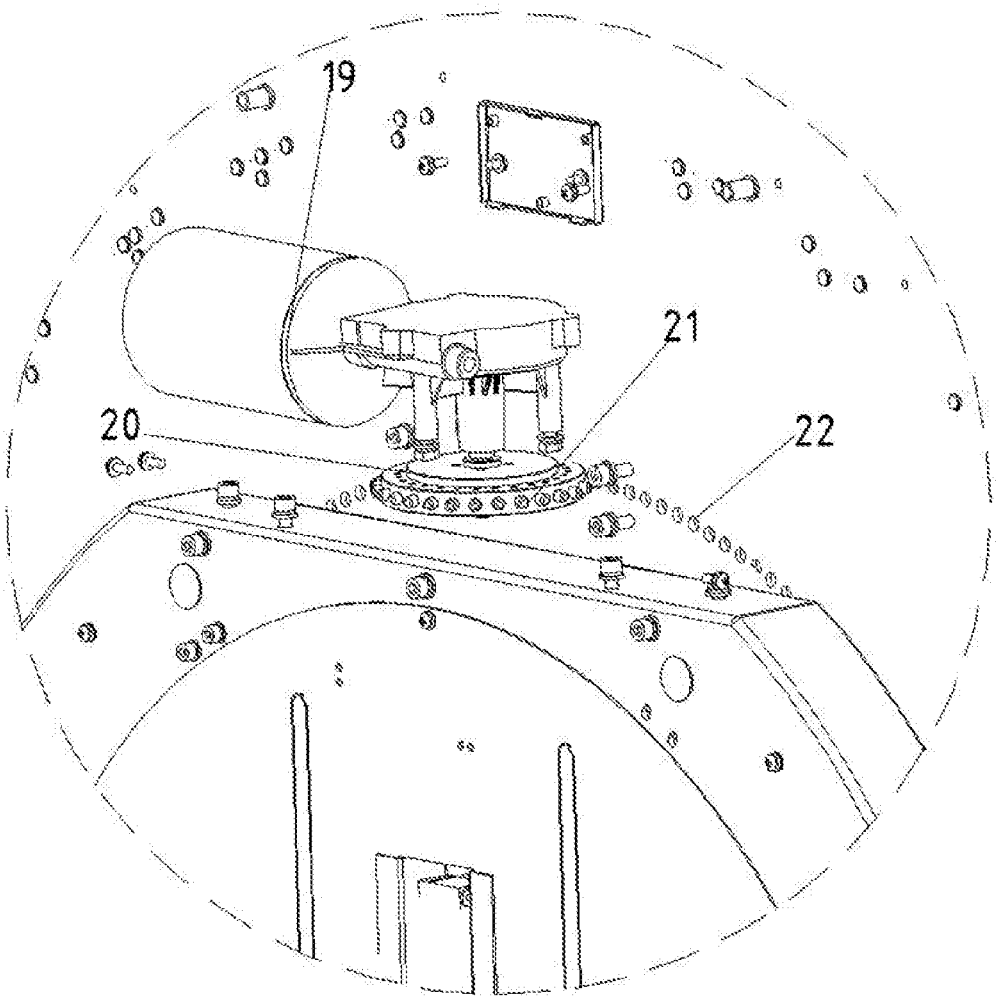
FIG. 9 is an enlarged view of B in FIG. 8.
Figure 10:
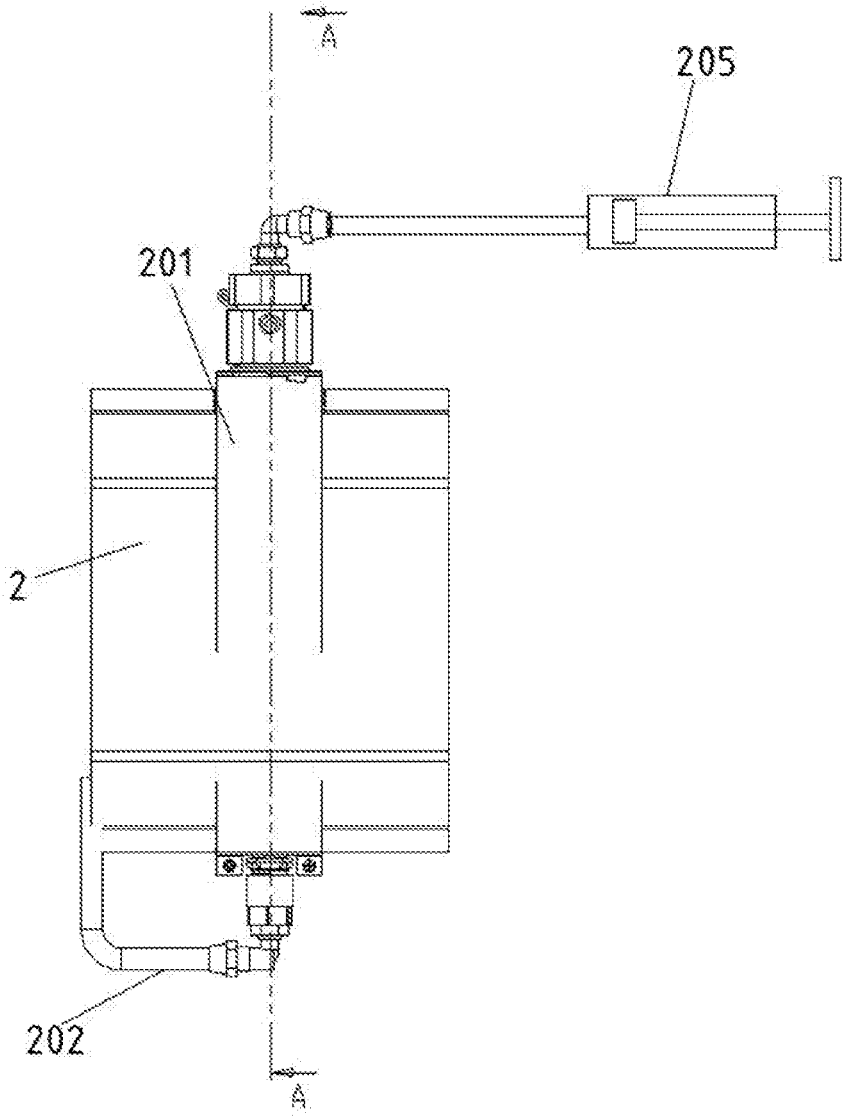
FIG. 10 is a structural schematic diagram of a color paste bag.
Figure 11:
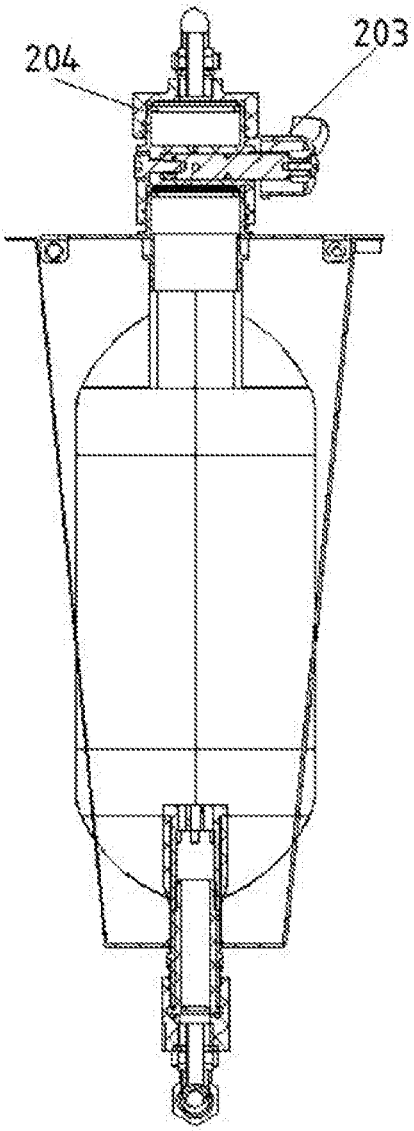
FIG. 11 is a sectional view of the color paste bag.
Figure 12:
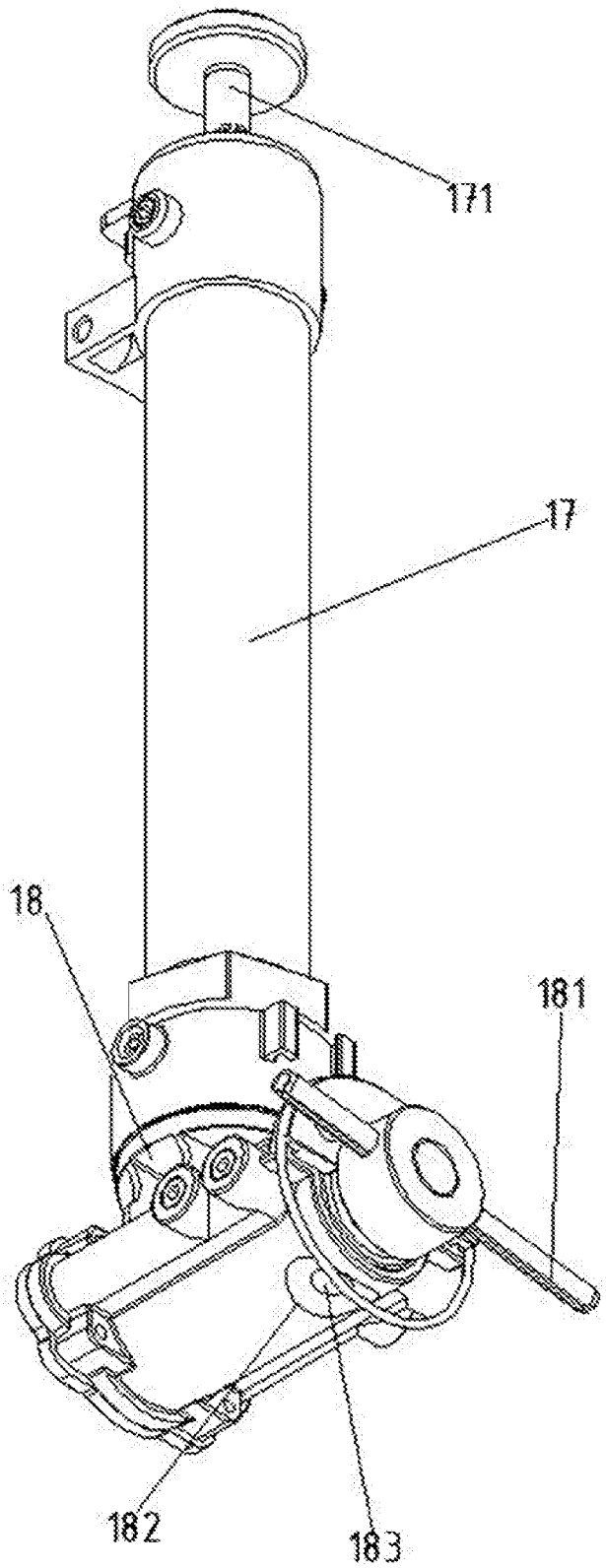
FIG. 12 is a structural schematic diagram of a piston pump and a valve body.

As shown in FIG. 1 to FIG. 12, a turntable color mixing machine includes a rack 1, a controller is arranged on the rack 1, a wheel-type turntable 3 that rotates vertically is arranged on the rack 1, a plurality of color paste bags 2 are arranged on the wheel-type turntable 3, the color paste bags 2 are evenly arranged along the circumference of the wheel-type turntable 3, the color paste bags 2 are connected with a piston pump 17 that is driven by a lifting mechanism to perform constant volume injection via a valve body 18, and a material receiving device that moves up and down is arranged at the middle of the wheel-type turntable 3, the valve body 18 has on-off and commutation functions, the piston pump 17 has the function of volume metering. At present, in the field of color mixing of vehicle refinishing paint, various color pastes are mixed according to weight ratios. This method requires an additional weighing device such as an electronic scale. In the present application, the color paste is injected by the piston pump 17 according to volume, the various color pastes can be mixed according to a volume ratio to achieve a predetermined effect, and no weighing device is needed.

A linear driving mechanism is arranged on the rack 1, and the material receiving device includes a moving platform, the moving platform is connected with the linear driving mechanism, so that the material receiving device performs up and down linear movement at the middle of the wheel-type turntable 3, the linear driving mechanism includes a moving frame 5, a gear 8 is connected above the moving frame 5 through a bearing seat 6, the gear 8 is connected with a moving motor 10 through a chain 7, the moving motor 10 is a servo motor, the moving motor 10 is electrically connected with a controller on the rack 1, the controller controls the moving motor 10 to work, a moving plate 9 is fixedly connected to the chain 7, the middle of the chain 7 is fixed with the moving plate 9, the chain 7 is applied to transmission to prevent a skidding phenomenon, the moving plate 9 is connected with the moving frame 5 through a pulley, that is, the moving plate 9 move up and down in the moving frame, the moving plate 9 is fixedly connected with a material receiving platform 4, a paint mixing cup is arranged on the material receiving platform 4, the middle of the wheel-type turntable 3 is hollowed up to serve as an up and down moving area of the moving platform, and when the color pastes are mixed, the paint mixing cup is placed on the moving platform in advance to prevent spillage from affecting the volume ratio.

A turntable motor 19 is arranged above the moving frame 5, the turntable motor 19 is a servo motor, the turntable motor 19 is connected with the controller on the rack 1, the controller controls the turntable motor 19 to work, a plurality of wheel pin holes 22 are formed in the circumference of one side of the wheel-type turntable 3 away from the piston pump 17, the turntable motor 19 is connected with a columnar driving wheel 20, the turntable motor 19 drives the wheel-type turntable 3 to rotate through driving wheel pins 21 on the driving wheel 20, the driving wheel pins 21 cooperate with the wheel pin holes 22 and are uniformly distributed on the entire circumference of one side of the wheel-type turntable 3 away from the piston pump, and when the turntable motor 19 drives the driving wheel pins 21 to rotate, the driving wheel pins 21 are in one-to-one correspondence with the wheel pin holes 22.

A valve body deflector rod 181 is arranged on the valve body 18, a paste outlet nozzle 182 is arranged below the valve body 18, an injection passage 183 is arranged in the valve body 18, the lifting mechanism includes a lifting frame 11, a valve motor 16 for shifting the valve body deflector rod 181 to connect or close the injection passage 183 and the paste outlet nozzle 182 is arranged on the lifting frame 11, a deflector rod 161 is arranged on the valve motor 16, the deflector rod 161 rotates to drive the valve body deflector rod 181 to rotate, a lifting driving mechanism is arranged on the lifting frame 11, a clamping block 15 that moves up and down is arranged on the lifting driving mechanism, the clamping block 15 lifts or presses the piston rod 171 of the piston pump 17, the lifting driving mechanism can be a lead screw 13 nut 14 mechanism, a steppe motor 12 is arranged on the lifting frame 11 to drive the rotating lead screw 13, the nut 14 is arranged on the lead screw 13, and the nut 14 is connected with the clamping block 15. The clamping block 15 is of a groove type mechanism, and the piston head of the piston rod 171 leaves or enters a groove located in the groove type mechanism when the wheel-type turntable 3 rotates. The nut 14 moves up and down to drive the clamping block 15, and the clamping block 15 drives the piston rod 171 to move up and down to suck and eject the color paste from the color paste bag 2.

A paste inlet is formed above the color paste bag 2, a paste outlet is formed below the color paste bag 2, the paste outlet is connected with the valve body 18 through a paste pipe 202, the paste inlet is in threaded connection with a plunger valve 203, a sealing cover 204 is connected above the plunger valve 203 through threads, the sealing cover 204 is connected with an air suction cylinder 205 through a hose, the plunger valve 203 is opened, the air suction cylinder 205 sucks out the air in the color paste bag 2 to prevent residual air from deteriorating the color paste, after the air is sucked, the plunger valve 203 is closed, the air suction cylinder 205 is removed so as not to prevent the rotation of the color paste bag 2 on the wheel-type turntable 3, meanwhile, in the rotation process, the color paste in the color paste bag 2 can also be fully stirred to prevent the color paste from drying out if being unused for a long time.

The valve body 18 is a return valve, the piston pump 17 is a large and small combined pump, such as the valve body 18 structure and the pump structure in the patent CN201410792479.7 or CN201711400600.7 or CN201310045508.9, the return valve is provided with a return passage, when the valve body 18 is in a closed state, that is, when no paste is injected, the return passage communicates with the color paste bag 2, and the mixed paint can return to the color paste. If the mixed paint is relatively viscous, if there is no return passage, the injection passage 183 is easy to dry and block, resulting in difficult paint discharge.

A plurality of supporting rods 31 are arranged on the inner periphery of the wheel-type turntable 3, the color paste bag 2 is fixedly connected with a hanging plate 201, the hanging plate 201 is fixedly connected between the supporting rod 31 and the adjacent supporting rod 301, the color paste bags 2 are arranged on a whole circumference in the wheel-type turntable 3, and meanwhile, the spaces of the color paste bags 2 are uniform through the supporting rods 31.

A cleaning component 23 for cleaning the paste outlet nozzle 182 is arranged on the wheel-type turntable 3, the cleaning component 23 includes a hair brush component 231 and a cleaning wheel component 232, the cleaning wheel component 232 includes a cleaning wheel shaft and a cotton gum cleaning wheel arranged on the cleaning wheel shaft, the hair brush component 231 includes a hair brush shaft and a hair brush, the hair brush shaft and the cleaning wheel shaft are both passive shafts, after the injection passage 183 is removed, the cleaning wheel component 232 passes through the paste outlet nozzle 182 at first, and then passes through the hair brush component 231, and the paste outlet nozzle 182 prevents the residual color paste from drying out.

The color paste bag 2 is a soft bag, which has good sealing property to prevent the air from entering, the wheel-type turntable 3 drives the color paste bag 2 to perform circular rotation, so that the color paste is turned up and down in the color paste bag 2 to achieve an even mixing effect so as to prevent the color paste from drying after being placed for a long time.

The working process is as follows:

A worker places color pastes in the corresponding color paste bags 2 in a one-to-one correspondence manner, when a bag of color paste is placed, the worker sucks out the air in the color paste bag 2 by using an air suction pipe to ensure that there is no air in the color paste bag 2, the controller starts to control the turntable motor 19 to work, the turntable motor 19 drives the wheel-type turntable 3 to rotate through the driving the wheel pins 21, the color paste bag 2 is turned up and down in the rotation process to ensure that the color paste is not dry, the piston pump 17 moves to the topmost side of the wheel-type turntable 3, that is, the piston rod 171 of the piston pump 17 is transported into the clamping block 15, the controller controls the lifting driving mechanism to start working, meanwhile, the controller controls the moving motor 10 to work, the moving motor 10 moves the moving plate 9 upward through the chain, the moving plate 9 drives the material receiving platform 4 to move upward, the paint mixing cup is placed on the material receiving platform 4 before the work, the lead screw 13 rotates to drive the nut 14 to move upward, the clamping block 15 drives the piston rod 171 of the piston pump 17 to rise to extract the color paste, after the piston rod 171 rises to a preset displacement, the valve motor 16 is started, so that the injection passage 183 of the valve body 18 communicates with the paste outlet nozzle 182, the piston rod 171 starts to descend, and a predetermined amount of color paste flows from the paste outlet nozzle 182 into the paint mixing cup.

It is particularly noteworthy that the controller is a PLC. It is well known to those skilled in the art and will not be described in detail in the specification.

The above descriptions are only preferred embodiments of the present invention. It should be noted that, for those skilled in the art, without departing from the overall concept of the present invention, several changes and improvements can be made, and these several changes and improvements should also be considered as the protection scope of the present invention.

The invention claimed is:

1. A turntable color machine, comprising:

a rack, and a controller arranged on the rack, wherein a turntable that rotates vertically is arranged on the rack, a plurality of color paste bags are arranged on the turntable, the turntable color machine further comprises:

plunger valves arranged in the color paste bags; and air suction cylinders configured to extract air from the color paste bags, the color paste bags are evenly arranged along the circumference of the turntable, the color paste bags are connected with a piston pump that is driven by a lifting mechanism to perform constant volume injection via a valve body, the piston pump is connected with the color paste bags and is configured to achieve volume injection, and a material receiving device that moves up and down is arranged at the middle of the turntable.

2. The turntable color machine according to claim 1, wherein a linear driving mechanism is arranged on the rack, and the material receiving device comprises a moving platform, and the moving platform is connected with the linear driving mechanism to perform up and down linear movement at the middle of the turntable.

3. The turntable color machine according to claim 2, wherein the linear driving mechanism comprises a moving frame, a gear is connected above the moving frame through a bearing seat, the gear is connected with a moving motor through a chain, the chain is fixedly connected with a moving plate, the moving plate is connected with the moving frame through a pulley, the moving plate is fixedly connected with a material receiving platform, and a paint mixing cup is arranged on the material receiving platform.

4. The turntable color machine according to claim 3, wherein a turntable motor is arranged above the moving frame, and a plurality of wheel pin holes are formed in the circumference of one side of the turntable away from the piston pump, the turntable motor is connected with a columnar driving wheel, and the turntable motor drives the turntable to rotate through driving wheel pins on the driving wheel.

5. The turntable color machine according to claim 1, wherein a valve body deflector rod is arranged on the valve body, a paste outlet nozzle is arranged below the valve body, an injection passage is arranged in the valve body, the lifting mechanism comprises a lifting frame, and a valve motor for shifting the valve body deflector rod to connect or close the injection passage and the paste outlet nozzle is arranged on the lifting frame.

6. The turntable color machine according to claim 5, wherein a lifting driving mechanism is arranged on the lifting frame, a clamping block that moves up and down is arranged on the lifting driving mechanism, and the clamping block lifts or presses a piston rod of the piston pump.

7. A turntable color machine, comprising:

a rack, and a controller arranged on the rack, wherein a turntable that rotates vertically is arranged on the rack, a plurality of color paste bags are arranged on the turntable, the color paste bags are evenly arranged along the circumference of the turntable, the color paste bags are connected with a piston pump that is driven by a lifting mechanism to perform constant volume injection via a valve body, and a material receiving device that moves up and down is arranged at the middle of the turntable, wherein a paste inlet is formed above each color paste bag of the color paste bags, a paste outlet is formed below each color paste bag of the color paste bags, the paste outlet is connected with the valve body through a paste pipe, the paste inlet is in threaded connection with a plunger valve, a sealing cover is connected above the plunger valve through threads, and the sealing cover is connected with an air suction cylinder through a hose.

8. The turntable color machine according to claim 1, wherein the valve body is a return valve, and the piston pump is a large and small combined pump.

9. The turntable color machine according to claim 1, wherein a plurality of supporting rods are arranged on the inner periphery of the turntable, each color paste bag of the color paste bags is fixedly connected with a hanging plate, and the hanging plate is fixedly connected between a supporting rod of the plurality of supporting rods and an adjacent supporting rod of the plurality of supporting rods.

10. The turntable color machine according to claim 1, wherein a cleaning component for cleaning a paste outlet nozzle is arranged on the turntable, the cleaning component comprises a hair brush component and a cleaning wheel component, the cleaning wheel component comprises a cleaning wheel shaft and a cotton gum cleaning wheel arranged on the cleaning wheel shaft, and the hair brush component comprises a hair brush shaft and a hair brush.

* * * * *